US011189966B2

(12) United States Patent
Wang et al.

(10) Patent No.: US 11,189,966 B2
(45) Date of Patent: Nov. 30, 2021

(54) SUB-MINIATURE PUSH-ON CONNECTORS MOUNTED IN A BASE HAVING A CLOSE-LOOP GROOVE CONTAINING SEAL

(71) Applicant: CommScope Technologies LLC, Hickory, NC (US)

(72) Inventors: Zhigang Wang, Suzhou (CN); Xun Zhang, Suzhou (CN); Ruixin Su, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/997,290

(22) Filed: Aug. 19, 2020

(65) Prior Publication Data

US 2021/0083423 A1 Mar. 18, 2021

(30) Foreign Application Priority Data

Sep. 16, 2019 (CN) ..... 201910875202.3

(51) Int. Cl.
*H01R 13/625* (2006.01)
*H01R 13/635* (2006.01)
*H01R 13/627* (2006.01)

(52) U.S. Cl.
CPC ..... *H01R 13/625* (2013.01); *H01R 13/635* (2013.01); *H01R 13/627* (2013.01)

(58) Field of Classification Search
CPC .. H01R 13/625; H01R 13/635; H01R 13/627; H01Q 1/12
See application file for complete search history.

(56) References Cited

U.S. PATENT DOCUMENTS 7,594,821 B1 * 9/2009 Hasija ..... G06Q 40/04 439/271
8,622,762 B2 * 1/2014 Van Swearingen .... H01R 24/38 439/248
10,122,079 B2 * 11/2018 Orem ..... H01Q 1/246
10,476,145 B2 * 11/2019 Newman ..... H05K 5/0039

* cited by examiner

*Primary Examiner* — Vanessa Girardi
(74) *Attorney, Agent, or Firm* — Myers Bigel, P.A.

(57) ABSTRACT

An integral SMP connector assembly for a base station antenna comprising a base, in which at least two SMP connectors are configured to extend away from a backplate of the base station antenna from an upper surface of the base, the base including: at least one connecting portion which connects the base to the backplate so that the upper surface of the base faces the backplate; and a close looped groove located in the upper surface of the base and surrounding the at least one connecting portion and the at least two SMP connectors. The integral SMP connector assembly further comprises a seal received in the groove and configured to provide an airtight seal between the upper surface of the base and the backplate.

16 Claims, 3 Drawing Sheets

SUB-MINIATURE PUSH-ON CONNECTORS MOUNTED IN A BASE HAVING A CLOSE-LOOP GROOVE CONTAINING SEAL

RELATED APPLICATION

The present application claims priority to and the benefit of Chinese Patent Application No. 201910875202.3, filed Sep. 16, 2019, the disclosure of which is incorporated herein by reference in its entirety.

FIELD OF THE INVENTION

The present disclosure relates generally to the field of connectors, and more particularly, to integral sub-miniature push-on (SMP) connector assemblies.

BACKGROUND OF THE INVENTION

As shown in FIGS. 1A and 1B, two SMP connectors 20' are often mounted in a backplate 10' of a base station antenna 1'. Each SMP connector 20' may be connected to a respective connectorized cable outside the backplate 10', and may be used, for example, for calibrating the amplitude and phase of the radiation pattern generated by an array of radiating elements of the base station antenna 1'. Each SMP connector 20' may be, for example, a power sub-miniature push-on (P-SMP) connector. Each SMP connector 20' is formed in a connector base 2'. The four corners of the connector base 2' are provided with four threaded connecting portions in the form of threaded holes 21' so that the SMP connector 20' may be connected to the backplate 10' of the base station antenna 1' by, for example, countersunk screws As shown in FIG. 2, a remote radio unit (RRU) panel 3' for receiving signals from a wireless control terminal may be mounted outside the backplate 10' of the base station antenna 1'. When mounted, the RRU panel 3' covers the connecting portion between the two SMP connectors 20' and the backplate 10'.

In some cases, it is necessary to maintain an airtight interface between the RRU panel 3' and the backplate 10'. This not only requires an airtight seal be maintained by the joint portion between the RRU panel 3' and the backplate 10', but also requires an airtight seal between the connector base 2' and the backplate 10'. Therefore, grooves 23' are provided on the connector base 2' and O-rings 4' are mounted in the grooves 23' to provide a seal between the backplate 10' and the connector base 2'. The grooves 23' and the O-rings 4', however, are disposed inward of the four threaded holes 21' and radially outward of the SMP connectors 20'. Because of this arrangement, it has been found that air leakage may occur at a threaded connecting portions between the countersunk screws 22' and the backplate 10' outward of the grooves 23' and the O-rings 4'.

Since the space for installation is limited, countersunk screws 22' having a small size are generally used to connect the SMP connector 20' to the backplate 10', and screw spacers mated therewith are also small. Therefore, the addition of the screw spacers cannot ensure that the threaded holes 21' are completely sealed. In addition, the gap between the two SMP connectors 20' is very small, and there is a small space external to the four threaded holes 21' of each connector base 2', so that the O-rings 4' cannot be expanded to the outside of the threaded holes 21'.

SUMMARY

One object of the present disclosure is to provide an integral SMP connector assembly capable of overcoming at least one drawback in the prior art.

According to the present disclosure, an integral SMP connector assembly for a base station antenna, includes a base, in which at least two SMP connectors are configured to extend away from a backplate of the base station antenna from an upper surface of the base, the base including: at least one connecting portion which connects the base to the backplate so that the upper surface of the base faces the backplate; and a close looped groove located in the upper surface of the base and surrounding the at least one connecting portion and the at least two SMP connectors; and a seal received in the groove and configured to provide an airtight seal between the upper surface of the base and the backplate.

In some embodiments, the seal is an elastomer seal.

In some embodiments, the seal has a height greater than the depth of the groove.

In some embodiments, the seal has at least one projection that protrudes from a lateral surface thereof.

In some embodiments, the at least one projection comprises a plurality of projections that are distributed along the length direction of the seal.

In some embodiments, the at least one projection comprises a plurality of projections that alternately protrude from the inner side surface and the outer side surface of the seal.

In some embodiments, the at least one projection has a chamfer.

In some embodiments, the bottom of the groove has a bottom recess recessed inwardly from the inner side surface of the groove or recessed outwardly from the outer side surface of the groove, and the seal has a projecting leg that is configured to mate with the bottom recess, wherein the projecting leg is configured to be insertable into the bottom recess.

In some embodiments, the bottom recess is a closed-loop recess.

In some embodiments, the bottom recess includes a plurality of spaced-apart segments, wherein each of the plurality of segments extends inwardly or outwardly from the groove, and the projecting leg of the seal has a plurality of segments that are configured to mate with the plurality of segments of the bottom recess.

In some embodiments, at least one of the SMP connectors is a P-SMP connector.

In some embodiments, the integral SMP connector includes a total of two SMP connectors.

In some embodiments, the at least one connecting portion consists of a total of eight connecting portions, with four connecting portions arranged about each respective SMP connector.

In some embodiments, the at least two SMP connectors comprise at least three SMP connectors arranged side-by-side or arranged in multiple rows and columns.

In some embodiments, the at least one connecting portion is a threaded connecting portion, a snap-fit connecting portion or a pin-hole connecting portion.

In some embodiments, the seal is formed as a rectangular-shaped ring.

Other features and advantages of the subject art of the present disclosure will be formulated in the following descriptions, and will be partially obvious from said descriptions, or may be learned by practicing the subject art of the present disclosure. Advantages of the subject art of the present disclosure will be realized and attained by the structure particularly set forth in the written description as well as its claims and drawings.

It should be understood that, the aforementioned general descriptions and the following detailed descriptions are all exemplary and descriptive, and intended to provide further illustrations of the subject art of the present disclosure for which protection is sought.

BRIEF DESCRIPTION OF THE DRAWINGS

After reading the embodiments hereinafter in conjunction with the accompanying drawings, a plurality of aspects of the present invention will be better understood. In the accompanying drawings.

DETAILED DESCRIPTION

Figure 1A:
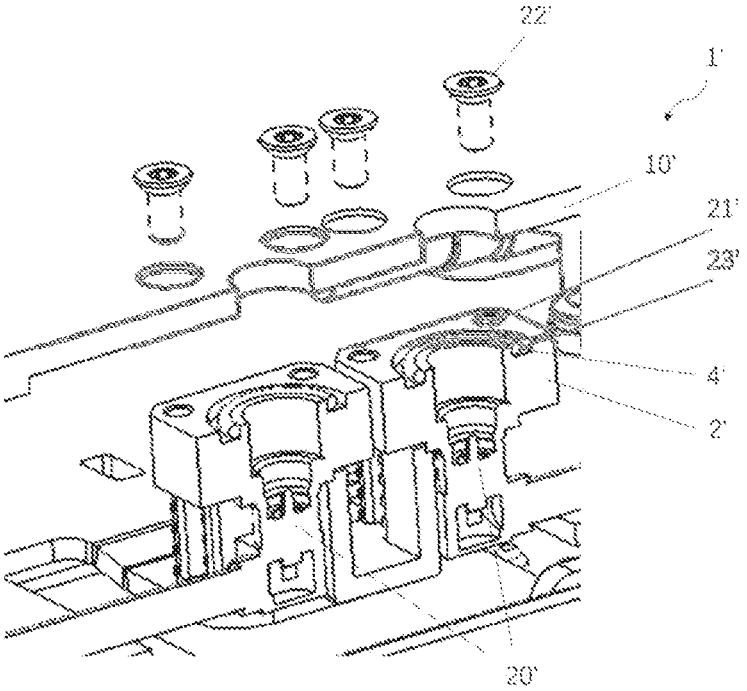
Fig. 1A (Prior Art)
FIG. 1A is a schematic view of an SMP connector assembly and an antenna backplate mated therewith in the prior art.
Figure 1B:
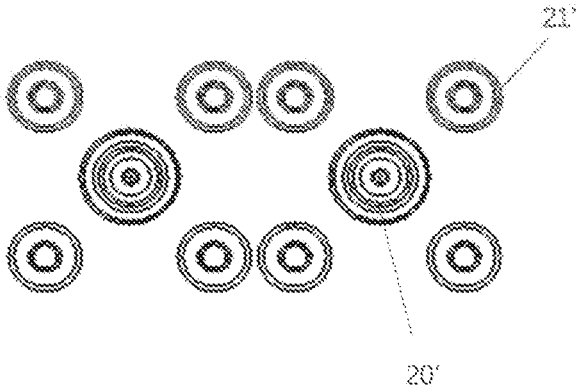
Fig. 1B (Prior Art)
FIG. 1B is a schematic view of the positional relationship between the SMP connectors and the threaded holes in FIG. 1A.
Figure 2:
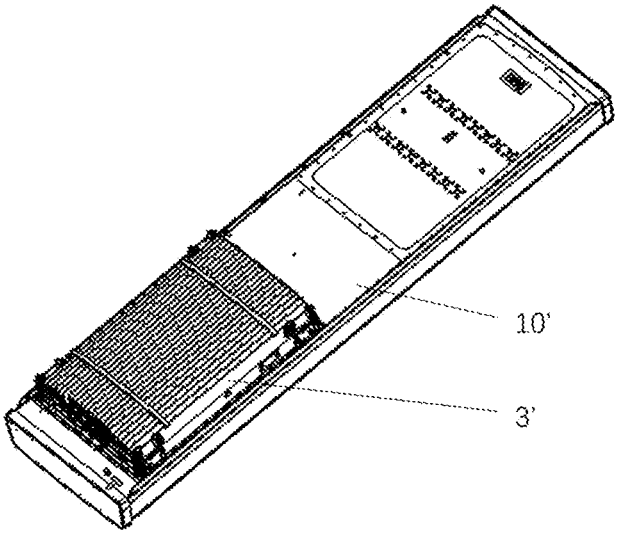
FIG. 2 is a perspective view of an antenna backplate covered with an RRU panel.

The present disclosure will be described below with reference to the drawings, in which several embodiments of the present disclosure are shown. It should be understood, however, that the present disclosure may be presented in multiple different ways, and not limited to the embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein can be combined in various ways to provide more additional embodiments.

It should be understood that, in all the drawings, the same reference numbers indicate the same elements. In the drawings, for the sake of clarity, the sizes of certain features may be deformed.

It should be understood that, the wording in the specification is only used for describing particular embodiments and is not intended to define the present disclosure. All the terms used in the specification (including the technical terms and scientific terms), have the meanings as normally understood by a person skilled in the art, unless otherwise defined. For the sake of conciseness and/or clarity, the well-known functions or constructions may not be described in detail any further.

The singular forms "a/an" and "the" as used in the specification, unless clearly indicated, all contain the plural forms as well. The wordings "comprising", "containing" and "including" used in the specification indicate the presence of the claimed features, but do not repel the presence of one or more other features. The wording "and/or" as used in the specification includes any and all combinations of one or more of the relevant items listed.

In the specification, when one element is referred to as being "on" another element, "attached to" another element, "connected to" another element, "coupled to" another element, or "in contact with" another element, the element may be directly located on another element, attached to another element, connected to another element, coupled to another element, or in contact with another element, or there may be an intermediate element. By contrast, when one element is referred to as being "directly" on another element, "directly attached to" another element, "directly connected to" another element, "directly coupled to" another element, or "in direct contact with" another element, there will not be an intermediate element. In the specification, when one feature is arranged to be "adjacent" to another feature, it may mean that one feature has a portion that overlaps with an adjacent feature or a portion that is located above or below an adjacent feature.

In the specification, the spatial relation wordings such as "up", "down", "left", "right", "forth", "back", "high", "low" and the like may describe a relation of one feature with another feature in the drawings. It should be understood that, the spatial relation wordings also contain different orientations of the apparatus in use or operation, in addition to containing the orientations shown in the drawings. For example, when the apparatus in the drawings is overturned, the features previously described as "below" other features may be described to be "above" other features at this time. The apparatus may also be otherwise oriented (rotated 90 degrees or at other orientations). At this time, the relative spatial relations will be explained correspondingly.

Figure 3:
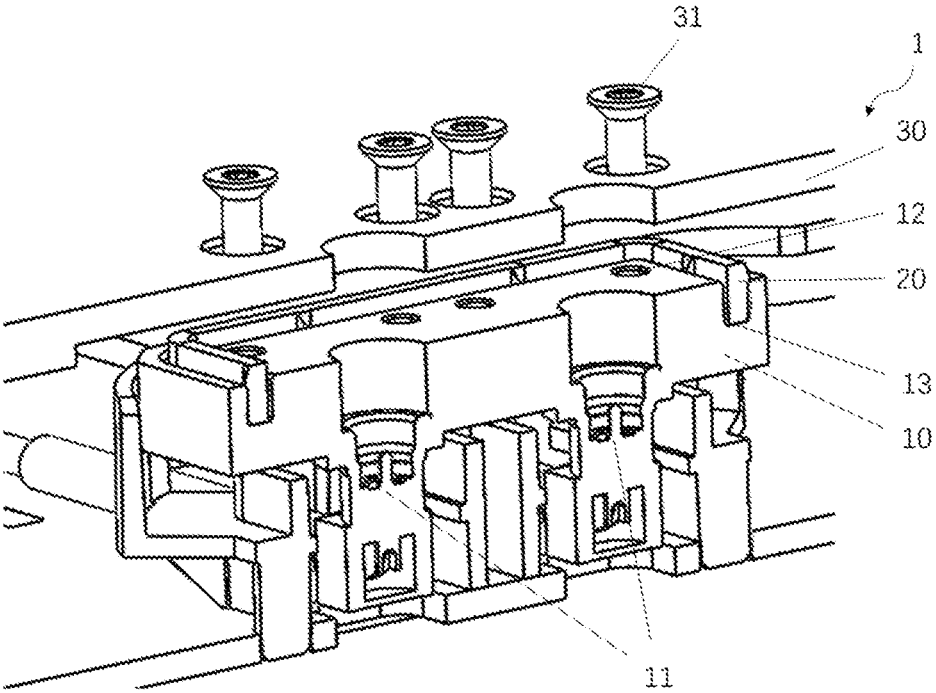
FIG. 3 is a schematic view of an integral SMP connector assembly according to an embodiment of the present invention.

As shown in FIG. 3, an integral SMP connector assembly 1 according to an embodiment of the present invention comprises a base 10 and a seal 20 disposed on the base 10. The base 10 is used to carry a pair of SMP connectors 11, while the seal 20 is used to maintain an airtight seal between the base 10 and the backplate 30 of the base station antenna.

The base 10 may have a substantially rectangular parallelepiped shape, and the upper surface of the base 10 may be closely connected to the inner surface of the backplate 30. Two SMP connectors 11 are provided side by side on the base 10, and each SMP connector 11 extends away from the backplate 30 from the upper surface of the base 10. Either of the two SMP connectors 11 may be a male connector or a female connector. The SMP connectors 11 may be connected to respective connectorized cables outside the backplate 30, and may be used to pass calibration data from the antenna to the RRU in order to calibrate the amplitude and phase of the radiation pattern generated by an array of radiating elements of the base station antenna.

In other embodiments, more than two SMP connectors 11, for example three, four or more SMP connectors, may also be provided on the base 10. The SMP connectors 11 may be arranged on the base 10 in side-by-side fashion, in multiple rows and multiple columns, or in any other appropriate arrangement.

Four threaded mounting holes 12 are provided in the base 10 around each of the SMP connectors 11, and are used to threadedly connect the base 10 to the inner surface of the backplate 30 by countersunk screws 31. In other embodiments, a total of four threaded mounting holes or some other number of threaded mounting holes may be provided around the two SMP connectors 11. The connection between the base 10 and the backplate 30 may not be limited to a threaded connection, and may be, for example, a snap-fit connection, a pin-hole connection, and the like.

A closed-loop groove 13 is provided in the base 10 around the threaded mounting holes 12 and the SMP connectors 11.

The groove is configured to receive a seal 20. The seal 20 is substantially strip-like, and may be made from material having certain elasticity, such as rubber or the like. The seal 20 is used to form an airtight seal between the base 10 and the antenna backplate 30, thereby sealing the space between the base 20 and the RRU panel 3'. Prior to mounting the base 10 to the backplate 30 of the base station antenna, the height of the seal 20, once it is received in the groove 13, may extend slightly beyond the upper surface of the base 10, thereby producing sealing effect when the base 10 is fastened to the backplate 30 of the base station antenna.

Figure 4A:
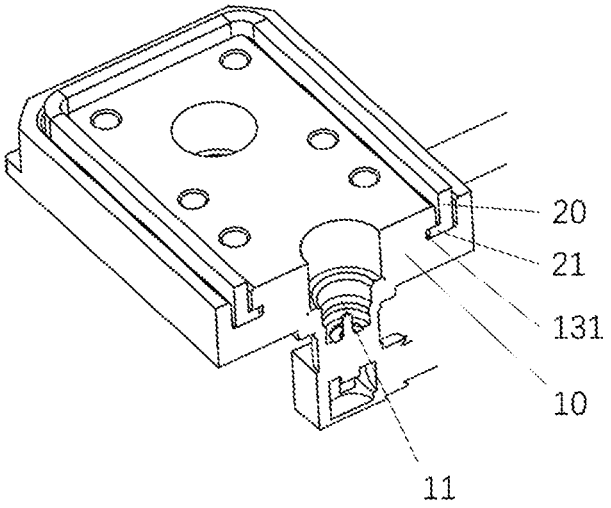
FIGS. 4A and 4B are cross-sectional views of a base and a seal of an integral SMP connector assembly according to another embodiment of the present invention.
Figure 4B:
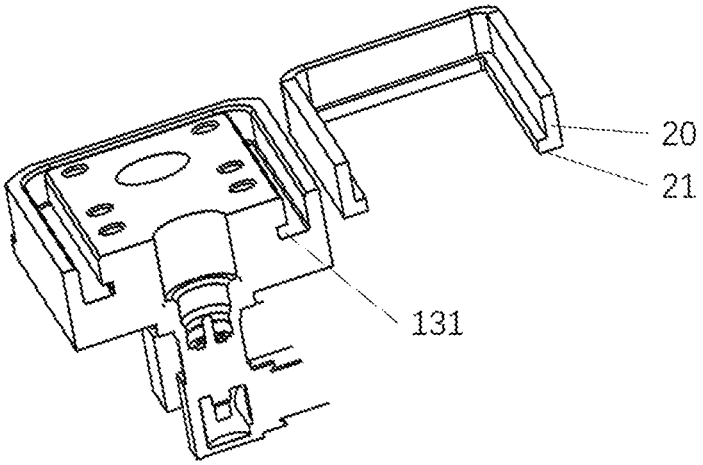

As shown in FIGS. 4A and 4B, a bottom recess 131 may be provided in the bottom of the groove 13. The bottom recess 131 may be a closed-loop recess. The seal 20 has a projecting leg 21 that is received within the bottom recess 131 when the seal 20 is inserted in the groove 13 to prevent the seal 20 from coming out of the groove 13 during transportation and installation. The bottom recess 131 may extend inwardly from the inner side surface of the groove 13 (as shown) or may extend outwardly from the outer side surface of the groove 13 in other embodiments. In other embodiments, the bottom recess 131 of the groove 13 may also be formed as a plurality of spaced apart segments, each of which may extend inwardly or outwardly to the groove 13. The projecting leg 21 may be configured to correspondingly have a plurality of segments that are mated with the plurality of segments of the bottom recess 131.

Figure 5:
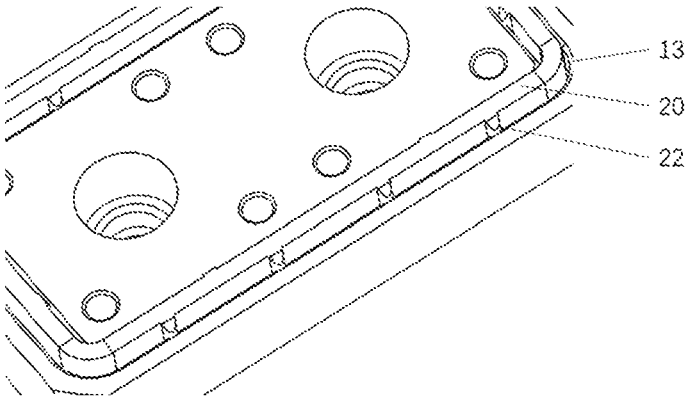
FIG. 5 is a partially enlarged view of the seal in FIG. 3.

FIG. 5 is a partially enlarged view of FIG. 3, in which the seal 20 is shown in greater detail. The seal 20 has one or more projections 22 protruding from its lateral surface, to increase friction between the seal 20 and the groove 13, and prevent the seal 20 from slipping out of the groove 13 during the transportation or installation. The projections 22 may be evenly distributed along the length direction of the seal 20 or unevenly distributed. The projections 22 may protrude from the inner side surface of the seal 20 or may protrude from the outer side surface of the seal 20. In some embodiments, the projections 22 alternately protrude from the inner side surface and the outer side surface of the seal 20 along the length direction of the seal 20. The projections 22 may have a chamfer to facilitate disposing the seal 20 into the groove 13.

The integral SMP connector assembly 1 according to embodiments of the present invention may provide an airtight seal between the SMP connector assembly 1 mounted inside the antenna backplate 30 and the antenna backplate 30, and has the advantages of small volume, easy machining, reliable sealing, convenient transportation, simple installation and the like.

Although the exemplary embodiments of the present disclosure have been described, a person skilled in the art should understand that, he or she can make multiple changes and modifications to the exemplary embodiments of the present disclosure without substantively departing from the spirit and scope of the present disclosure. Accordingly, all the changes and modifications are encompassed within the protection scope of the present disclosure as defined by the claims. The present disclosure is defined by the appended claims, and the equivalents of these claims are also contained therein.

What is claimed is:

1. An integral sub-miniature push-on (SMP) connector assembly for a base station antenna, comprising:

a base, in which at least two SMP connectors are configured to extend away from a backplate of the base station antenna from an upper surface of the base, the base comprising:

at least one connecting portion which connects the base to the backplate so that the upper surface of the base faces the backplate; and a close looped groove located in the upper surface of the base and surrounding the at least one connecting portion and the at least two SMP connectors; and a seal received in the groove and configured to provide an airtight seal between the upper surface of the base and the backplate.

2. The integral SMP connector assembly according to claim 1, wherein at least one of the SMP connectors is a power sub-miniature push-on (P-SMP) connector.

3. The integral SMP connector assembly according to claim 1, wherein the at least two SMP connectors comprise at least three SMP connectors arranged side-by-side or arranged in multiple rows and columns.

4. The integral SMP connector assembly according to claim 1, wherein the at least one connecting portion is a threaded connecting portion, a snap-fit connecting portion or a pin-hole connecting portion.

5. The integral SMP connector assembly according to claim 1, wherein the seal is formed as a rectangular-shaped ring.

6. The integral SMP connector assembly according to claim 1, wherein the seal is an elastomer seal.

7. The integral SMP connector assembly according to claim 6, wherein the seal has a height greater than the depth of the groove.

8. The integral SMP connector assembly according to claim 1, wherein the integral SMP connector includes a total of two SMP connectors.

9. The integral SMP connector assembly according to claim 8, wherein the at least one connecting portion consists of a total of eight connecting portions, with four connecting portions arranged about each respective SMP connector.

10. The integral SMP connector assembly according to claim 1, wherein the bottom of the groove has a bottom recess recessed inwardly from the inner side surface of the groove or recessed outwardly from the outer side surface of the groove, and the seal has a projecting leg that is configured to mate with the bottom recess, wherein the projecting leg is configured to be insertable into the bottom recess.

11. The integral SMP connector assembly according to claim 10, wherein the bottom recess is a closed-loop recess.

12. The integral SMP connector assembly according to claim 10, wherein the bottom recess includes a plurality of spaced-apart segments, wherein each of the plurality of segments extends inwardly or outwardly from the groove, and the projecting leg of the seal has a plurality of segments that are configured to mate with the plurality of segments of the bottom recess.

13. The integral SMP connector assembly according to claim 1, wherein the seal has at least one projection that protrudes from a lateral surface thereof.

14. The integral SMP connector assembly according to claim 13, wherein the at least one projection comprises a plurality of projections that are distributed along the length direction of the seal.

15. The integral SMP connector assembly according to claim 13, wherein the at least one projection comprises a plurality of projections that alternately protrude from the inner side surface and the outer side surface of the seal.

16. The integral SMP connector assembly according to claim 13, wherein the at least one projection has a chamfer.

* * * * *